US005127645A

United States Patent [19]

Torisawa

[11] Patent Number: 5,127,645

[45] Date of Patent: Jul. 7, 1992

[54] SHEET FEED CONTROL SYSTEM

[75] Inventor: Nobuyuki Torisawa, Minami-ashigara, Japan

[73] Assignee: Fuji Photo Film Co., Ltd., Kanagawa, Japan

[21] Appl. No.: 595,134

[22] Filed: Oct. 10, 1990

[30] Foreign Application Priority Data

Oct. 12, 1989 [JP] Japan ..... 1-267431

[51] Int. Cl.[5] ..... B65H 5/08

[52] U.S. Cl. ..... 271/11; 271/106; 271/107; 271/262

[58] Field of Search ..... 271/5, 11, 12, 14, 105–107, 271/270, 262, 263, 267, 273

[56] References Cited

U.S. PATENT DOCUMENTS 4,585,222 4/1986 Nishibori et al. ..... 271/107 X
4,968,019 11/1990 Tanabe et al. ..... 271/107 X

FOREIGN PATENT DOCUMENTS 3622693 1/1988 Fed. Rep. of Germany ..... 271/107
211242 9/1986 Japan ..... 271/107
262348 10/1988 Japan ..... 271/5

*Primary Examiner*—Robert P. Olszewski
*Assistant Examiner*—Boris Milef
*Attorney, Agent, or Firm*—Sughrue, Mion, Zinn, Macpeak & Seas

[57] ABSTRACT

A sheet feed control system for use in an image recording apparatus, for example, includes a suction cup for attracting a sheet-like member such as a photographic film under suction, a crank mechanism for moving the suction cup with respect to the sheet-like member, and a swinging mechanism for swinging the suction cup with the sheet-like member attracted thereto to impart swinging action to the sheet-like member. The crank mechanism is drived by a pulse motor in response to a control signal applied thereto, and the swinging mechanism is drived by a pulse motor in response to a control signal applied thereto. Information, such as rotational speeds and angular displacements, with regard to the pulse motors is stored in a memory, and desired information corresponding to certain physical properties of the sheet-like member, can be selected from the memory by the operator. A controller controls operation of the pulse motors to impart appropriate swinging action to the sheet-like member based on the selected information which is read from the memory.

10 Claims, 11 Drawing Sheets

GOOD
NO GOOD
FILM FEEDABILITY
SMALL
LARGE
SWINGING MOVEMENT
FILM SURFACE ROUGHNESS
FILM RIGIDITY
LOW
HIGH
SWINGING SPEED

SHEET FEED CONTROL SYSTEM

BACKGROUND OF THE INVENTION

1. Field of the Invention

The present invention relates to a sheet feed control system for automatically controlling a sheet feed mechanism which feeds sheet-like members such as unexposed photographic films in medical image recording apparatus.

2. Prior Art

Recently, there have widely been employed image recording apparatus in which image information produced by a computerized tomographic system or the like is displayed on a CRT display unit or the like, and the displayed image information is recorded on a photographic light-sensitive medium such as a photographic film and thereafter developed into a visible image for medical diagnosis or the like.

In such an image recording apparatus, sheet-like members such as photographic light-sensitive mediums, which are stacked in a magazine, are taken out by a sheet feed mechanism, and then transported to an exposure position by a sheet transporting mechanism.

It is necessary to feed photographic light-sensitive mediums, reliably one by one, from the magazine for subsequent correct exposure operation. To meet such a requirement, it has been customary to operate a suction cup or the like of the sheet feed mechanism with a combination of a motor as a drive source and mechanical elements that are operatively coupled to the motor.

Since the operation of the sheet feed mechanism is determined solely by the operative interlinked coupling between the drive source and the mechanical elements, if physical properties of the sheet-like members are modified or the image recording apparatus is placed in a different environment, the sheet-like members may not be properly fed one at a time from the magazine because the basic operation of the sheet feed mechanism remains unchanged.

If the sheet-like members were not properly fed from the magazine, desired images would not accurately be recorded on the sheet-like members. In the case where the image recording apparatus is used for medical diagnosis, it would be highly difficult or impossible for the doctor to make an appropriate diagnosis due to inaccurate or defective images.

SUMMARY OF THE INVENTION

It is a major object of the present invention to provide a sheet feed control system which selectively operates a driving source to drive a sheet feed mechanism based on physical properties of sheet-like members or the environment where the sheet-like members are used, so that the sheet-like members can properly be fed one at a time from a magazine.

Another object of the present invention is to provide a sheet feed control system comprising, moving means for moving a suction cup to suck a sheet-like member with respect to the sheet-like member, a swinging means for attracted thereto to impart a swinging action to the sheet-like member, a first driving means for driving the moving means in response to a control signal applied thereto, a second driving means for driving the swinging means in response to a control signal applied thereto, a memory means for storing information with regard to the control signals applied to the first and second driving means, an information selecting means for selecting information corresponding to at least physical properties of the sheet-like member, from the information with regard to the control signals stored in the memory means, and a control means for reading the information selected from the memory means and controlling operation of the first and second driving means based on the selected information read from the memory means.

Still another object of the present invention is to provide a sheet feed control system wherein the moving means comprises a crank mechanism derived by the first driving means.

Yet another object of the present invention is to provide a sheet feed control system wherein the swinging means comprises a worm rotatable by the second driving means and a worm gear meshing with the worm, the suction cup being angularly movable with the worm gear about an axis coaxial with the worm gear.

Yet still another object of the present invention is to provide a sheet feed control system wherein the swinging means includes an angle detecting means for detecting swinging angle of the sheet-like member in terms of swinging angle of the suction cup.

A further object of the present invention is to provide a sheet feed control system wherein the angle detecting means comprises a rotary encoder.

A still further object of the present invention is to provide a sheet feed control system wherein the information with regard to the control signals includes data on swinging movements and swinging speeds corresponding to physical properties, such as surface roughness and rigidity, of sheet-like members.

A yet further object of the present invention is to provide a sheet feed control system wherein the information selecting means comprises means for selecting data on a smaller swinging movement and a lower swinging speed if the sheet-like member has a lager surface roughness and a larger rigidity, and for selecting data on a larger swinging movement and a higher swinging speed if the sheet-like member has a smaller surface roughness and a smaller rigidity.

A yet still further object of the present invention is to provide a sheet feed control system wherein the control means comprises means for controlling operation of the first and second driving means according to control signals based on the data from the memory means and signals corresponding to the swinging angle detected by the angle detecting means.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
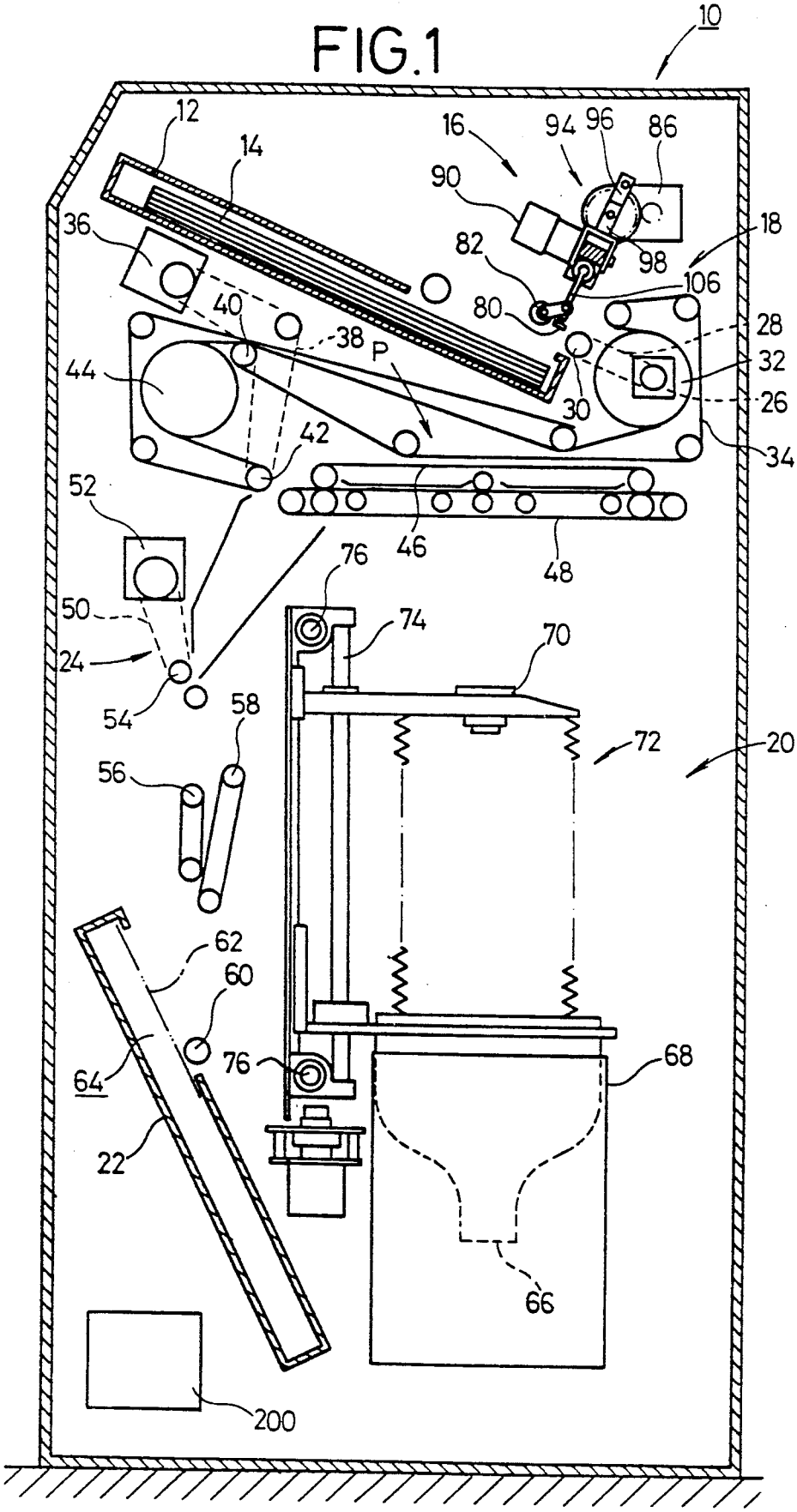
FIG. 1 is a schematic vertical cross-sectional view of an image recording apparatus which incorporates a sheet feed control system according to the present invention.

FIG. 1 shows an image recording apparatus which incorporates therein a sheet feed control system according to the present invention. The image recording apparatus, generally denoted at 10, comprises a sheet feed mechanism 16 for taking out stacked sheet-like unexposed photographic light-sensitive mediums 14, one by one, from a magazine 12, a sheet transporting mechanism 18 for transporting an unexposed photographic light-sensitive medium 14, which has been taken out from the magazine 12, to an exposure station P, an exposure mechanism 20 disposed below the exposure station P, for exposing the photographic light-sensitive medium 14 to image information, and another sheet transporting mechanism 24 for transporting an exposed photographic light-sensitive medium 14 to a magazine 22.

In the sheet transporting mechanism 18, a photographic light-sensitive medium 14 is transported past a fixed roller 30 which is rotated by a motor 26 through a belt 28, and then transported while being reversed by a drum 32 and a belt 34 held in contact therewith. Then, the photographic light-sensitive medium 14 is transported along the outer circumferential surface of a drum by drive rollers 40, 42 which are rotated by a motor 36 through a belt 38. At this time, the photographic light-sensitive medium 14 is reversed again. The photographic light-sensitive medium 14 thus reversed again is transported to the exposure station P.

In the exposure station P, a first belt conveyor 46 and a second belt conveyor 48 are placed in contact with each other in the horizontal direction. The photographic light-sensitive medium 14 is positioned in the exposure station P by the belt conveyors 46, 48 when they are rotated.

After the photographic light-sensitive medium 14 has been exposed by the exposure mechanism 20, the belt conveyors 46, 48 are rotated in the opposite direction to direct the photographic light-sensitive medium 14 toward the sheet transporting mechanism 24. The photographic light-sensitive medium 14 is transported by a drive roller 54 rotated by a motor 52 through a belt 50 and belt conveyors 56, 58 which are rotated by a motor (not shown), and stored in the magazine 22. The magazine 22 has a shutter 62 which has a rack held in mesh with a pinion 60. An opening 64 present is opened and closed by the shutter 62 in the magazine 22.

The exposure mechanism 20 has an image display device 68 for displaying image information on a CRT display unit 66, and an optical system 72 for projecting the image information displayed on the CRT display unit 66 onto the photographic light-sensitive medium 14 through a focusing lens 70.

The image display device 68 and the optical system 72 are vertically movable along a guide rail 74, and the image display device 68, the optical system 72, and the guide rail 74 are movable along guide rails 76 in a direction normal to the sheet of FIG. 1. Therefore, the image display device 68 and the optical system 72 are movable to an optimum position required for exposure of the photographic light-sensitive medium 14 to be exposed.

Figure 2:
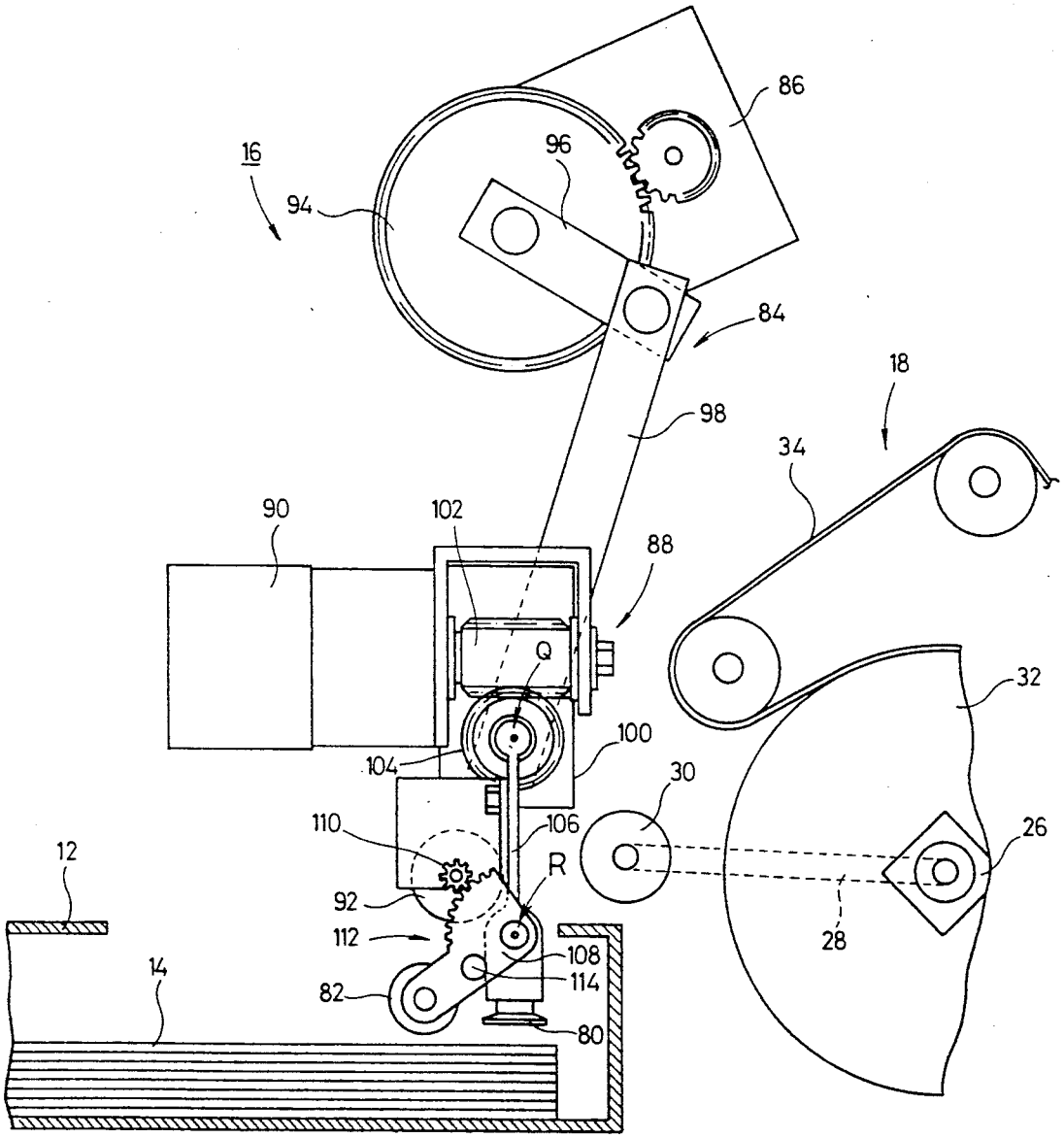
FIG. 2 is an enlarged elevational view of a mechanism for detecting the number of photographic light-sensitive mediums in the image recording apparatus shown in FIG. 1.

As shown in FIG. 2, the sheet feed mechanism 16 comprises a suction cup or pad 80 for attracting or sucking a photographic light-sensitive medium 14 and taking out the same from the magazine 12, a movable roller 82 movable toward and away from the fixed roller 30 of the sheet transporting mechanism 18, a crank mechanism (moving means) 84 for moving the suction cup 80 and the movable roller 82 into the magazine 12, and a pulse motor (first driving means) 86 for driving the crank mechanism 84.

In order to give a flying or swinging action to a photographic light-sensitive medium 14 taken out from the magazine 12, the sheet feed mechanism 16 also has a swinging mechanism (swinging means) 88 for swinging the suction cup 80, a pulse motor (second actuator) 90 for driving the swinging mechanism 88, and a rotary encoder 92 for producing a pulse signal in response to movement of the movable roller 82 toward the fixed roller 30.

The crank mechanism 84 comprises a disc member 94 rotatable by the pulse motor 86, a first arm 96 rotatably fixed at one end to the center of the disc member 94, and a second arm 98 rotatably supported on the other end of the first arm 96. The other end of the second arm 98 is rotatably supported in a casing 100 of the swinging mechanism 88 at a position about which the suction cup 80 is angularly movable.

The casing 100 of the swinging mechanism 88 houses a worm 102 mounted on the output shaft of the pulse motor 90 and a worm gear 104 held in mesh with the worm 102. When the worm 102 is rotated by the pulse motor 90, the worm gear 104 rotates about a central axis Q thereof.

The suction cup 80 is mounted on one end of a swinging rod 106, the other end of which is rotatably supported on the worm gear 104 at the central axis Q thereof. When the pulse motor 90 is energized, the suction cup 80 is caused by the worm 102, the worm gear 104, and the swinging rod 106 to swing about the central axis Q.

The movable roller 82 is rotatably mounted on an attachment member 108, which is angularly movably supported on the swinging rod 106 for angular movement about an axis R. The attachment member 108 has integral teeth 112 along an arcuate edge thereof which are held in mesh with a pinion 110 that is mounted on an input shaft of the rotary encoder 92.

Upon swinging movement of the swinging rod 106, the attachment member 108 and the movable roller 82 swing about the central axis Q. At this time, the attachment member 108 also swings about the axis R, so that the input shaft of the rotary encoder 92 rotates. As a result, the rotary encoder 92 produces a pulse signal corresponding to the angle through which the input shaft of the rotary encoder 92 rotates. More specifically, the number of pulses produced by the rotary encoder 92 varies depending on the angle to which the movable roller 82 swings about the axis R through the attachment member 108.

The attachment member 108 is limited in its swinging movement by a stopper pin 114 when the stopper pin 114 abuts against the swinging rod 106. When the attachment member 108 swings downwardly due to the weight of the movable roller 82, the stopper pin 114 is brought into abutment against the swinging rod 106, thereby preventing the movable roller 82 from moving into a position near the lower suction surface of the suction cup 80. Therefore, the attracting or sucking operation of the suction cup 80 is not obstructed by the movable roller 82.

Figure 4:
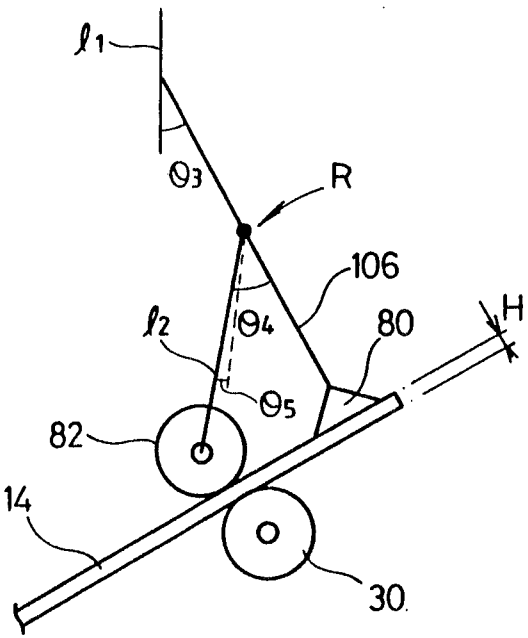
FIGS. 3 and 4 are schematic diagrams showing the principle of detecting the number of photographic light-sensitive mediums which have been picked up, based on the distance which a movable roller has moved from the condition in which a photographic light-sensitive medium is not nipped to the condition in which it is nipped.
Figure 3:
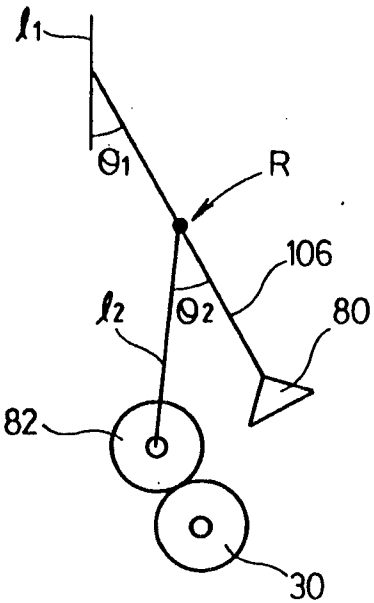

It is now assumed, as shown in FIGS. 3 and 4, that a vertical straight line is represented by $l_1$, and the axis R and the central axis of the movable roller 82 are interconnected by a straight line $l_2$. In FIG. 3, no photographic light-sensitive medium 14 is nipped between the movable roller 82 and the fixed roller 30. In FIG. 4, a photographic light-sensitive medium 14 is nipped between the movable roller 82 and the fixed roller 30. When the swinging rod 106 swings to the right in FIG. 2, the angle $\theta_1$ formed between the straight line $l_1$ and the line indicating the longitudinal direction of the swinging rod 106 in the condition shown in FIG. 3 is equal to the angle $\theta_2$ formed between the straight lines $l_2$ and the line indicating the longitudinal direction of the swinging rod 106 in the condition shown in FIG. 4 ($\theta_1=\theta_3$), but the angle formed between the straight line $l_2$ and the line indicating the longitudinal direction of the swinging rod 106 is larger when the photographic light-sensitive medium 14 is nipped than when no photographic light-sensitive medium is nipped ($\theta_4>\theta_2$). Stated otherwise, when the movable roller 82 and the fixed roller 30 nips a photographic light-sensitive medium 14 therebetween, the movable roller 82 and the fixed roller 30 are spaced apart from each other by a distance H which corresponds to the thickness of the nipped photographic light-sensitive medium 14.

If the position where the movable roller 82 is held in abutment against the fixed roller 30 with no photographic light-sensitive medium 14 nipped, as shown in FIG. 3, is a reference position, then the movable roller 82 is displaced from the reference position by the distance H when the photographic light-sensitive medium 14 is nipped between the movable roller 82 and the fixed roller 30. The angle $\theta_4$ is therefore greater than the angle $\theta_2$ by an angle $\theta_5$ which corresponds to the distance H. The angle $\theta_5$ which is the difference between the angle $\theta_4$ and the angle $\theta_2$ is substantially proportional to the distance H. Measurements are made beforehand of the thickness of a singe photographic light-sensitive medium 14, the angle $\theta_5$ when one photographic light-sensitive medium 14 is nipped between the movable roller 82 and the fixed roller 30, and the number of pulses generated by the rotary encoder 92 when the movable roller 82 is angularly moved by the angle $\theta_5$. In actual operation, when the number of pulses generated by the rotary encoder 92 is measured, the distance H by which movable roller 82 is spaced from the reference position can be calculated, and as a result the number of photographic light-sensitive mediums 14 which have been taken out of the magazine 12 can be calculated.

Figure 5:
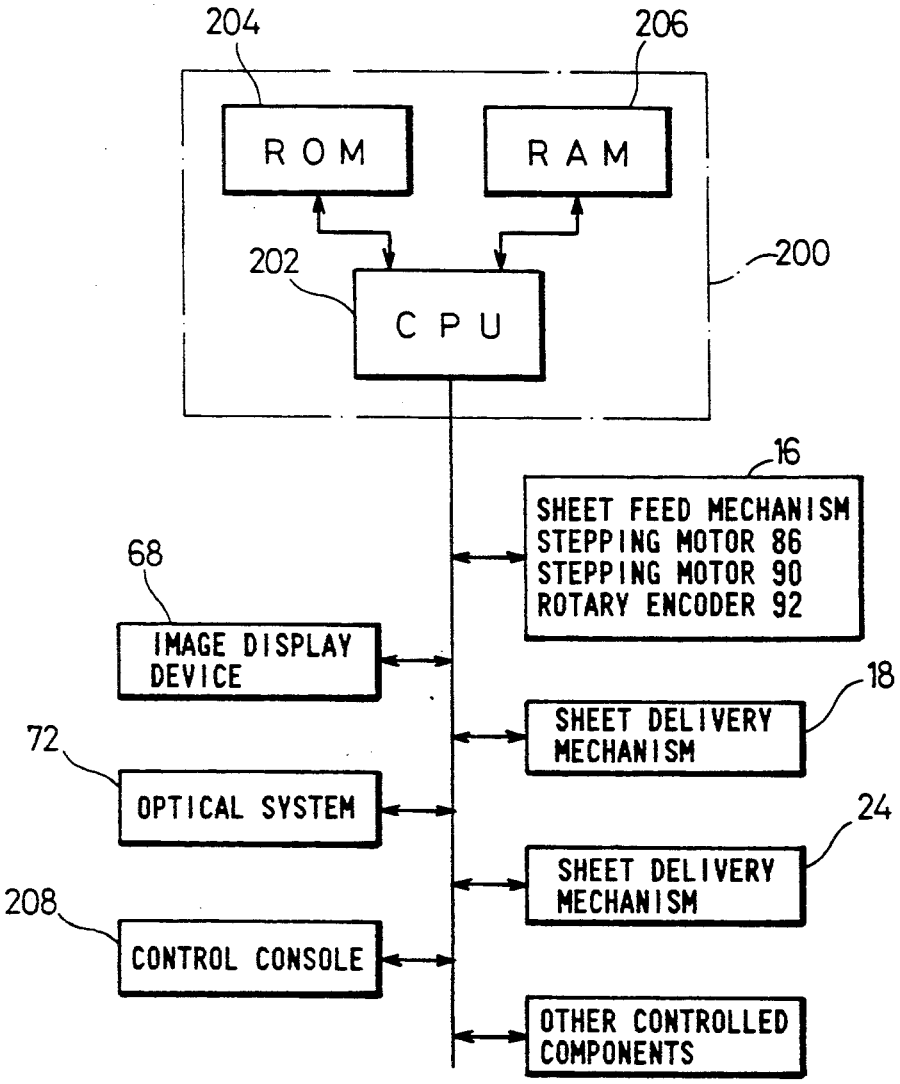
FIG. 5 is a block diagram of an electric arrangement of the image recording apparatus shown in FIG. 1.

FIG. 5 shown in block form a major electric arrangement of the image recording apparatus 10. As shown in FIG. 5, a controller 200 comprises a CPU 202 serving as a control means, a program ROM 204 which stores a program for operating the CPU 202 according to a predetermined procedure, and a working RAM 206 for storing various data. The CPU 202 controls operation of the sheet feed mechanism 16, the sheet transporting mechanisms 18, 24, the image display device 68, the optical system 72, a control console 208, and other controllable components (e.g., the drive rollers 40, 42) according to the program stored in the program ROM 204.

Figures 6A, 6B, 6C:
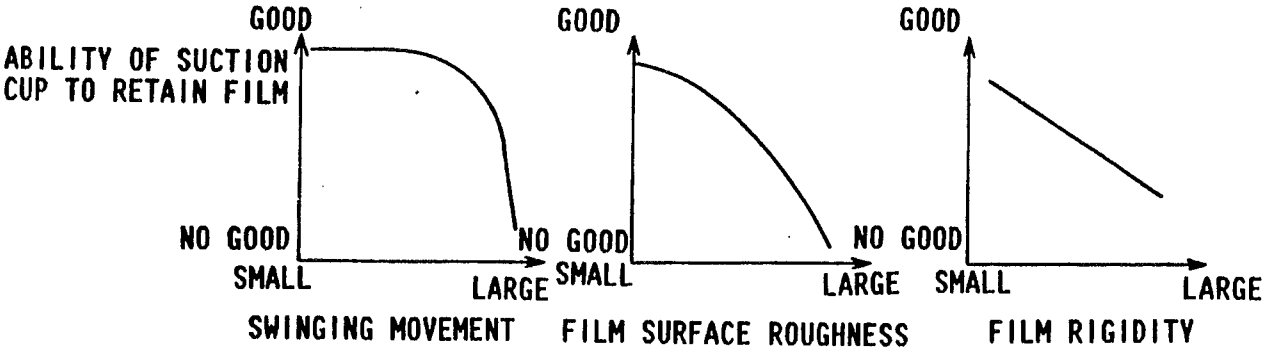
FIGS. 6(*a*) through 6(*c*), 7(*a*) through 7(*d*), and 8(*a*) and 8(*b*) are diagrams showing the relationship between physical properties of a photographic light-sensitive medium and swinging action thereof.

The ROM 204, serving as a memory means, stores rotational speeds and angular displacements of the pulse motors 86, 90, which correspond to physical properties of different photographic light-sensitive mediums 14, such as surface roughness and rigidity. As illustrated in FIGS. 6(*a*) through 6(*c*), the ability of the suction cup 80 to retain the photographic light-sensitive medium 14 becomes poorer as the swinging movement given to the photographic light-sensitive medium 14 is larger, as the surface roughness of the photographic light-sensitive medium 14 is larger, and as the rigidity of the photographic light-sensitive medium 14 is larger.

Figures 7A, 7B, 7C, 7D:
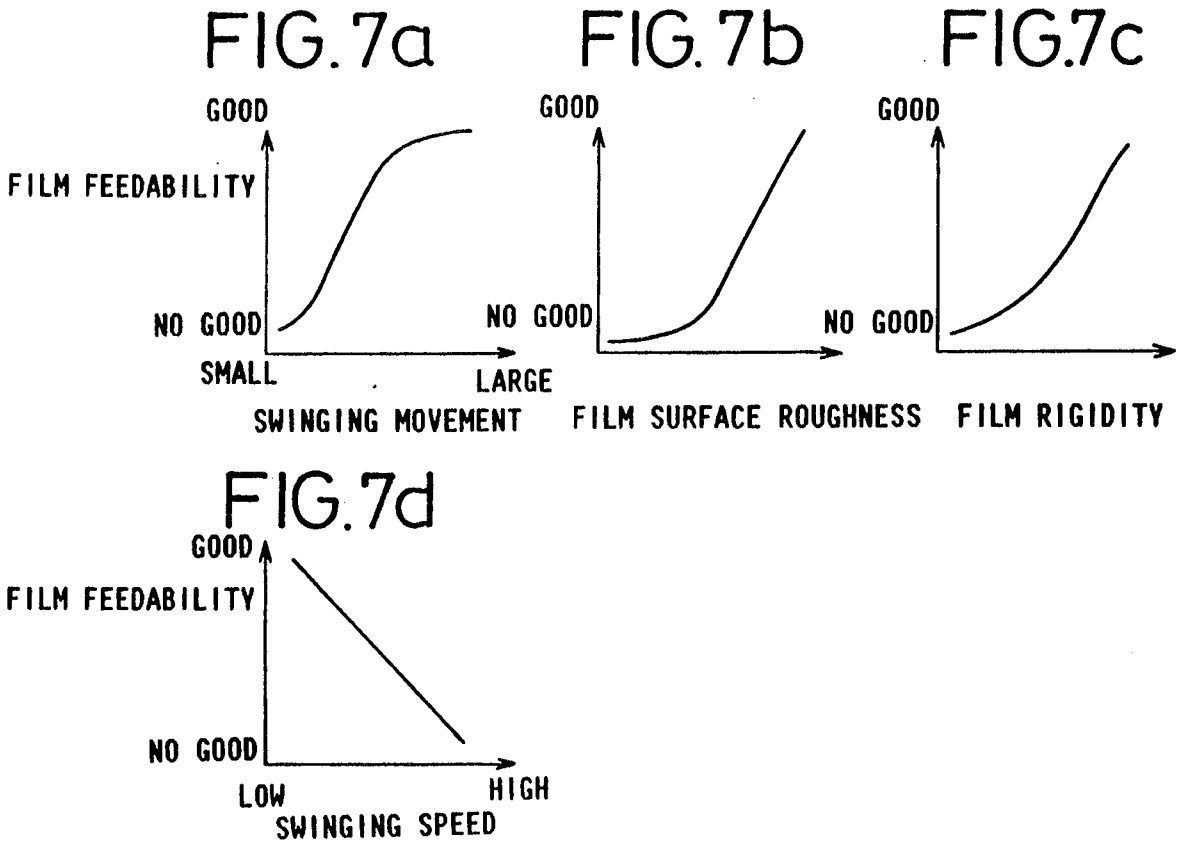

As shown in FIGS. 7(*a*) through 7(*d*), the ease with which the photographic light-sensitive medium 14 is fed from the cassette 12, or the feedability of the photographic light-sensitive medium 14, becomes greater as the swinging movement given to the photographic light-sensitive medium 14 is larger, as the surface roughness of the photographic light-sensitive medium 14 is greater, and as the rigidity of the photographic light-sensitive medium 14 is larger, but becomes poorer as the swinging speed or the photographic light-sensitive medium 14 is higher.

In view of the foregoing considerations, if a photographic light-sensitive medium 14 has a large surface roughness and a high rigidity, then it can well be fed from the magazine 12 when the swinging movement given to the photographic light-sensitive medium 14 is small and the swinging speed thereof is low. If a photographic light-sensitive medium 14 has a smooth surface and is less rigid, then it can well be fed from the magazine 12 when the swinging movement is larger and the swinging speed is low.

Figure 8A:
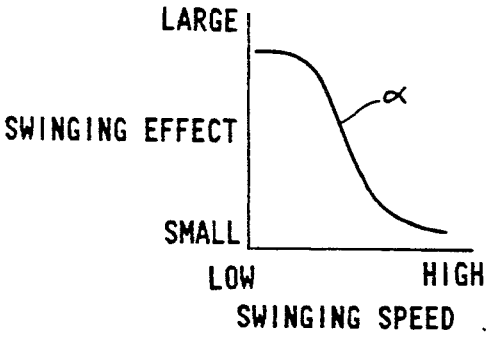
Figure 8B:
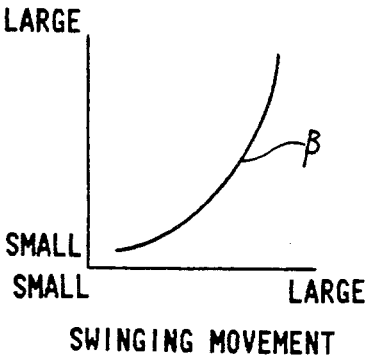

As shown in FIG. 8(*a*), the relationship between the swinging speed and a swinging effect to reliably feed a single photographic light-sensitive medium 14 from the magazine is represented by a curve $\alpha$. As shown in FIG. 8(*b*), the relationship between the swinging movement given to a photographic light-sensitive medium 14 and the swinging effect with respect to the photographic light-sensitive medium 14 is represented by a curve $\beta$.

The rotational speeds and angular displacements of the pulse motors 86, 90, which are stored in the ROM 204 as information with regard to control signals to be given to the pulse motors 86, 90, are representative of such swinging speeds and swinging movements to be given to photographic light-sensitive mediums 14.

The swinging speeds and swinging which are thus stored in the ROM 204 can be by the operator through the control console 208 depending on the surface roughness and rigidity of a light-sensitive medium 14 used. Stated otherwise based on the information entered through the control 208, the CPU 202 selects a control signal stored in and corresponding to the entered information, and operation of the pulse motors 86, 90 according to the selected control signal.

Ambient data regarding environments of the image recording apparatus 10, such as a temperature, a humidity, etc. may be stored in the ROM 204 as control signal information which will be used to select a swinging speed and a swinging movement.

A processing sequence to be executed by the CPU 202 will be described below with reference to the flowcharts shown in FIGS. 9 through 12.

Figure 9:
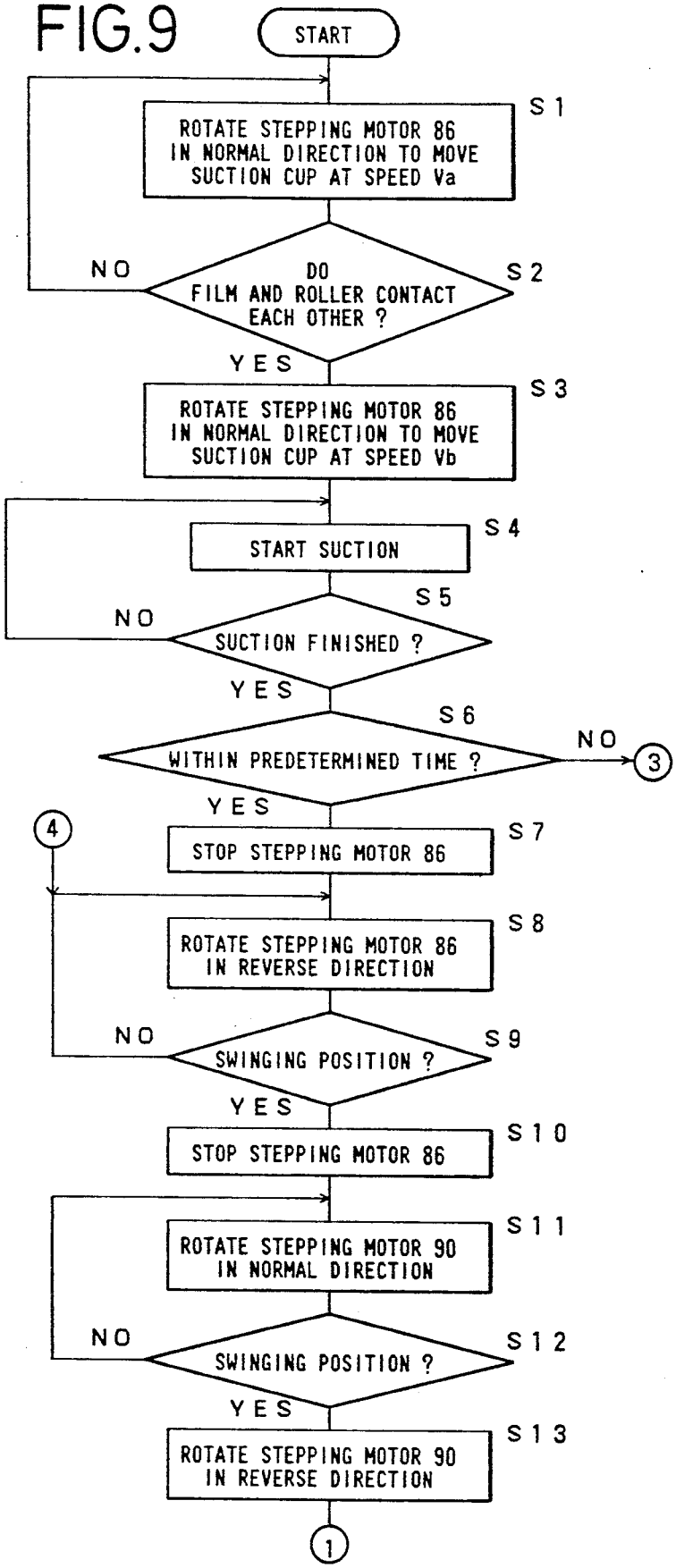
FIGS. 9 through 12 are flowcharts of a processing sequence executed by a CPU in the electric arrangement shown in FIG. 5.

When the power supply of the controller 200 is turned on, the CPU 202 starts to control the image recording apparatus. First, the pulse motor 86 is swung in a normal direction to move the suction cup 80 toward the photographic light-sensitive medium 14 in the magazine 12 at a speed Va in a step S1 (FIG. 9). Angular movement of the movable roller 82 through a certain angle is confirmed by an electric signal which is read from the rotary encoder 92 into the CPU 202. When it is confirmed by such an electric signal that the movable roller 82 contacts the photographic light-sensitive medium 14 in a step S2, the rotational speed of the pulse motor 86 is lowered to move the suction cup 80 at a speed Vb lower than the speed Va in a step S3. The suction cup 80 now starts attracting or sucking the photographic light-sensitive medium 14 in a step S4.

If the attracting action is finished in a step S5 and completed within a predetermined period of time in a step S6, then the pulse motor 86 is de-energized in a step S7. Thereafter, the pulse motor 86 is reversed, or swung in a reverse direction to move the suction cup 80 in the opposite direction away from the magazine 12 in a step S8.

In this embodiment, the suction cup 80 is placed in a predetermined position when it imparts a swinging action to the photographic light-sensitive medium 14. If it is confirmed that the suction cup 80 has moved to a given swinging station in a step S9, then the pulse motor 86 is de-energized in a step S10, and the pulse motor 90 is energized in a normal direction in a step S11.

Figure 10:
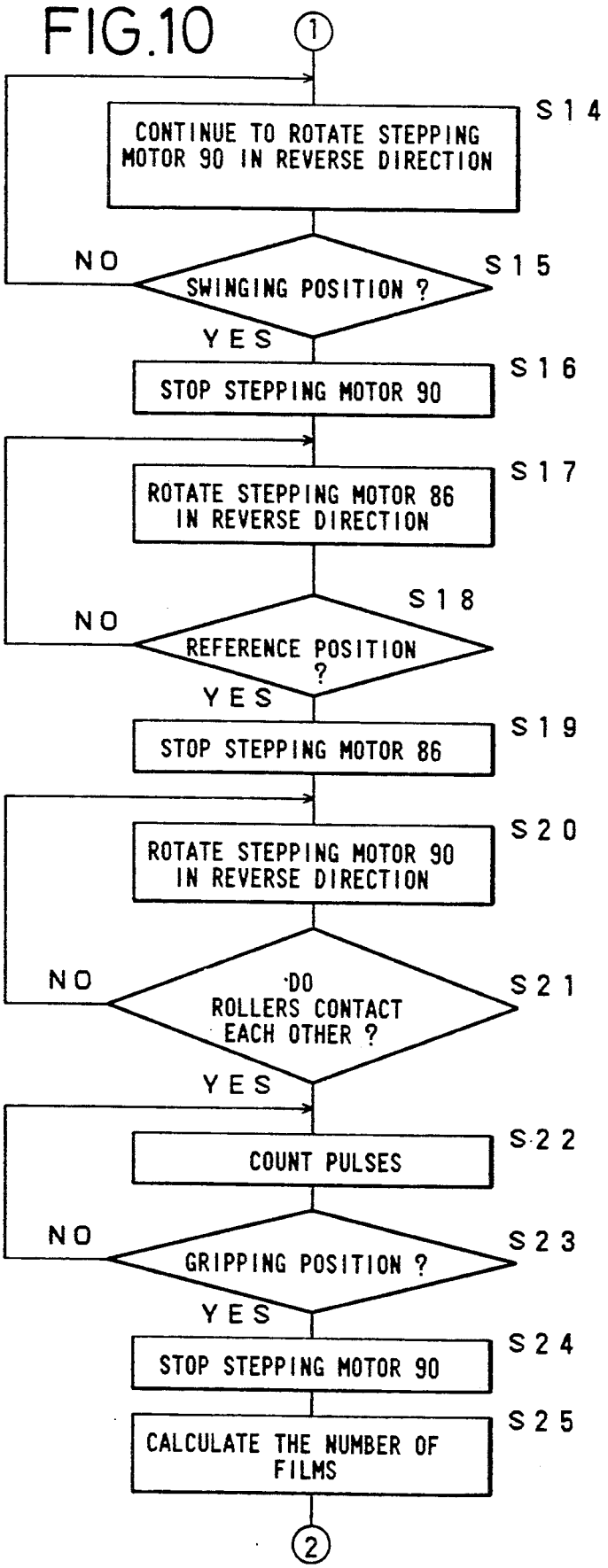
Figure 11:
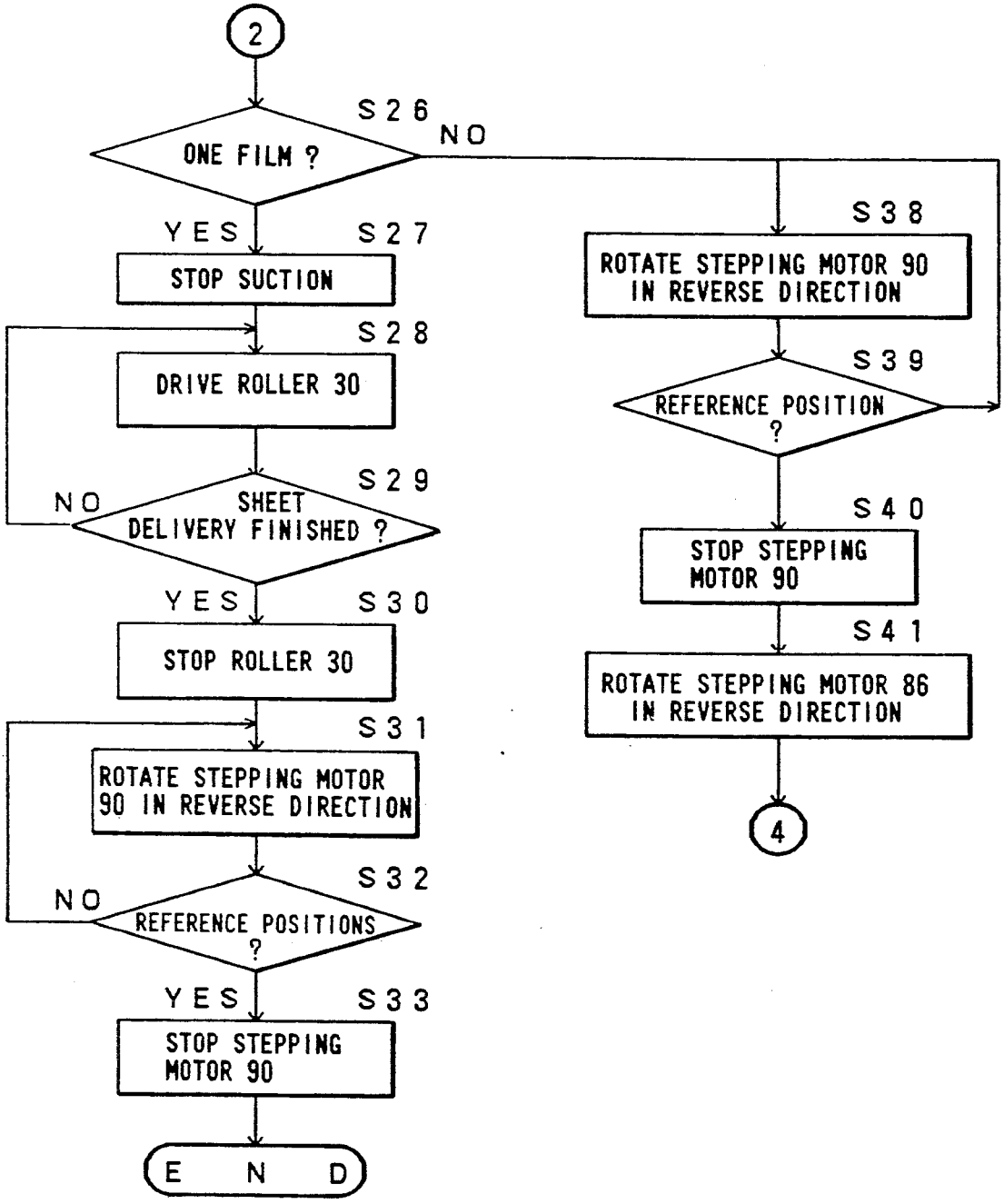

If the suction cup 80 has been moved to a given swinging station by the pulse motor 90 in a step S12, then the pulse motor 90 is de-energized and energized in a reverse direction in a step S13. The pulse motor 90 is continuously reversed in a step S14 (FIG. 10). If the suction cup 80 has reached the swinging station again in a step S15, then the pulse motor 90 is de-energized in a step S16 and the pulse motor 86 is energized in the reverse direction in a step S17. The suction cup 80 therefore moves away from the magazine 12. If the suction cup 80 moves to a reference station in which the movable roller 82 and the fixed roller 30 nip the photographic light-sensitive medium 14 in a step S18, the pulse motor 86 is de-energized in a step S19 and the pulse motor 90 is swung in the reverse direction in a step S20. If it is confirmed that the movable roller 82 and the fixed roller 30 contact each other in a step S21, then the pulses of a pulse signal generated by the rotary encoder 92 are counted in a step S22. If the movable roller 82 moves to a station (nipping station) for the movable roller 82 and the fixed roller 30 to nip the photographic light-sensitive medium 14 in a step S23, then the pulse motor 90 is de-energized in a step S24, and the number of photographic light-sensitive mediums 14 that have been fed out of the magazine 12 is calculated from the number of pulses counted in a step S22, in a step S25 (see FIGS. 3, and 4).

If it is confirmed that only one photographic light-sensitive medium 14 has been fed so far in a step S26 (FIG. 11), the sucking action of the suction cup 80 is stopped in a step S27, thereby releasing the photographic light-sensitive medium 14 from the suction cup 80. Then, the fixed roller 30 is swung to transport the photographic light-sensitive medium 14 with the sheet transporting mechanism 18 in a step S28. If the sheet transporting operation is stopped in a step S29, the rotation of the fixed roller 30 is stopped in a step S30.

Then, the pulse motor 90 is energized in the reverse direction in a step S31. If the suction cup 80 reaches the reference station (standby station) in a step S32, then the pulse motor 90 is de-energized in a step S33.

Figure 12:
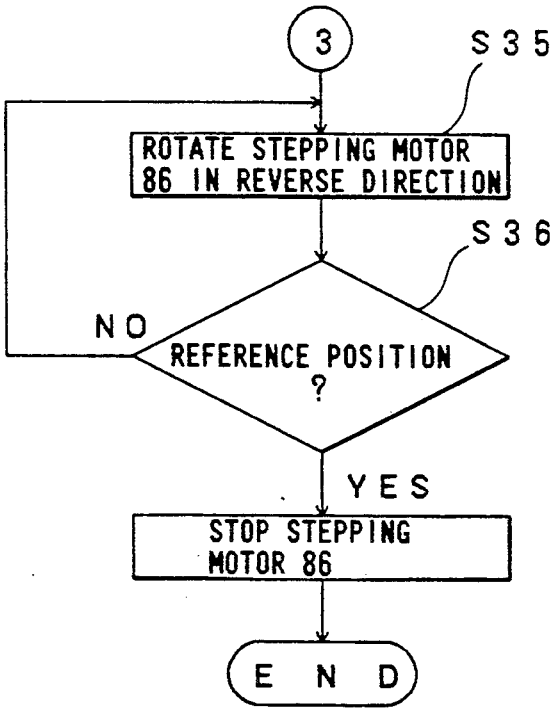

If the photographic light-sensitive medium 14 is not attracted in the predetermined period of time in the step S6, then the pulse motor 86 is energized in the reverse direction in a step S35 (FIG. 12). If it is confirmed that the suction cup 80 reaches the reference station in a step S36, then the pulse motor 86 is de-energized in a step S37, and the processing is finished. The flowchart shown in FIG. 12 is concerned with the processing when no photographic light-sensitive medium is contained in the magazine 12.

If it is determined in the step S26 that the magazine 12 still contains two or more photographic light-sensitive mediums 14, then the stepping motor 90 is energized in the reverse direction in a step S38. If the suction cup 80 is determined as having reached the reference station in a step S39, the pulse motor 90 is de-energized in a step S40, and the pulse motor 86 is energized in the reverse direction in a step S41. Thereafter, control returns to the step S8 to repeat the steps following the step S8.

With the aforesaid embodiment, as described above, the sheet feed mechanism 16 has the crank mechanism 84 including the pulse motor 86 as an actuator and the swinging mechanism 88 with the pulse motor 90 as an actuator. Data regarding swinging speeds and swinging movements for swinging or flying actions to be imparted to the photographic light-sensitive medium 14 are stored in the ROM 204. The stored data can be selected by the operator through the control console 208. Based on the swinging speed and swinging movement which are selected by the operator through the control console 208, the CPU 202 controls operation of the pulse motors 86, 90 in order to impart a desired swinging or flying action to the photographic light-sensitive medium 14.

The suction cup 80 is angularly moved in a manner to optimize the swinging action to be imparted to the photographic light-sensitive medium 14, depending on some physical properties of the photographic light-sensitive medium 14, such as the surface roughness, rigidity, etc. Therefore, the photographic light-sensitive medium 14 can reliably be fed out of the magazine 12 by the sheet feed mechanism 16.

In the case where the image recording apparatus 10 and an external diagnostic system are connected through an interface for automatically photographing radiation images of a patient, it is possible to select the rotational speed of the pulse motor 86 so that the sheet feeding cycle can match the photographing cycle.

The sheet-like members which can be handled in the sheet feed control system according to the present invention may be copy sheets or other sheets or films which are to be fed one by one, instead of photographic light-sensitive mediums.

As described above, the sheet feed control system according to the present invention has a memory means for storing information regarding control signals which control operation of a first actuator for actuating a moving means and a second actuator for actuating a swinging means. The stored information can be selected by the operator through an information selecting means. In operation, desired information is read from the memory means by the operator, and the first and second actuators are controlled in operation by the control means based on the read information.

a sheet-like member is therefore given a swinging or flying action which corresponds to physical properties of the sheet like member or environments in which the image reading apparatus is used. Accordingly, the sheet-like member can reliably be fed out of the magazine.

Although a certain preferred embodiment has been shown and described, it should be understood that many changes and modifications may be made therein without departing from the scope of the appended claims.

What is claimed is:

1. A sheet feed control system comprising:

a moving means for moving a suction cup to suck a sheet-like member;

a swinging means for swinging said suction cup with the sheet-like member attracted thereto to impart a swinging action to the sheet-like member;

a first driving means for driving said moving means in response to a control signal applied thereto;

a second driving means for driving said swinging means in response to a control signal applied thereto;

a memory means for storing a plurality of control signals to be applied to said first and second driving means;

an information selecting means for selecting information concerning at least physical properties of the sheet-like member, said information corresponding to respective control signals from among said plurality of control signals stored in said memory means; and a control means for reading the respective control signals from said memory means which correspond to information selected in said information selecting means and controlling operation of said first and second driving means based on the read control signals.

2. A sheet feed control system according to claim 1, wherein said moving means comprises a crank mechanism driven by said first driving means.

3. A sheet feed control system according to claim 1, wherein said swinging means comprises a worm rotatable by said second driving means and a worm gear meshing with said worm, said suction cup being angularly movable with said worm gear about an axis coaxial with said worm gear.

4. A sheet feed control system according to claim 1, wherein said swinging means includes an angle detecting means for detecting swinging of the sheet-like member in terms of swinging angle of the suction cup.

5. A sheet feed control system according to claim 4, wherein said angle detecting means comprises a rotary encoder.

6. A sheet feed control system according to any of claims 1 to 5, wherein said control signals control the swinging movements and swinging speeds of said suction cup.

7. A sheet feed control system according to any of claims 1 to 5, wherein said control signals control the swinging movements and swinging speeds of said suction cup, and wherein said selected information concerns at least the physical properties of surface roughness and rigidity, wherein said suction cup is controlled such that for a first surface roughness and first rigidity, said suction cup moves at a first swinging movement and first swinging speed, and for a second smaller surface roughness and second smaller rigidity, said suction cup moves at a second swinging movement and second swinging speed higher than said first swinging movement and first swinging speed.

8. A sheet feed control system according to claims 4 or 5, wherein said control means comprises means for controlling operation of said first and second driving means according to control signals read from said memory means and signals corresponding to the swinging angle detected by said angle detecting means.

9. A sheet feed control system according to claim 6, wherein said selected information concerns at least physical properties of surface roughness and rigidity, wherein said suction cup is controlled such that for a first surface roughness and first rigidity, said suction cup moves at a first swinging movement and first swinging speed, and for a second smaller surface roughness and second smaller rigidity, said suction cup moves at a second swinging movement and second swinging speed higher than said first swinging movement and first swinging speed.

10. A feed sheet control system according to any of claims 1 to 5, wherein said memory means further includes ambient data of said control system which is utilized in selecting swinging movements and swinging speeds of said suction cup.

* * * * *